US008356665B2

(12) United States Patent
Vittoratos et al.

(10) Patent No.: US 8,356,665 B2
(45) Date of Patent: Jan. 22, 2013

(54) METHOD FOR RECOVERING HEAVY/VISCOUS OILS FROM A SUBTERRANEAN FORMATION

(75) Inventors: Euthimios Vittoratos, Anchorage, AK (US); Bradley W. Brice, Anchorage, AK (US)

(73) Assignee: BP Corporation North America Inc., Houston, TX (US)

( * ) Notice: Subject to any disclaimer, the term of this patent is extended or adjusted under 35 U.S.C. 154(b) by 368 days.

(21) Appl. No.: 12/575,826

(22) Filed: Oct. 8, 2009

(65) Prior Publication Data

US 2010/0089573 A1 Apr. 15, 2010

Related U.S. Application Data

(60) Provisional application No. 61/104,563, filed on Oct. 10, 2008, provisional application No. 61/196,538, filed on Oct. 17, 2008.

(51) Int. Cl.
*E21B 43/22* (2006.01)

(52) U.S. Cl. ..... 166/270

(58) Field of Classification Search ..... None
See application file for complete search history.

(56) References Cited

U.S. PATENT DOCUMENTS

| | | | | |
|---|---|---|---|---|
| 2,725,106 | A | 11/1955 | Spearow | |
| 2,731,414 | A | 1/1956 | Binder, Jr. et al. | |
| 2,827,964 | A | 3/1958 | Sandiford et al. | |
| 3,084,743 | A * | 4/1963 | West et al. | 166/402 |
| 3,102,587 | A * | 9/1963 | Holm et al. | 166/402 |
| 3,685,581 | A | 8/1972 | Hess et al. | |
| 4,018,281 | A | 4/1977 | Chang | |
| 4,085,799 | A | 4/1978 | Bousaid et al. | |
| 4,690,215 | A | 9/1987 | Roberts et al. | |
| 4,884,635 | A | 12/1989 | McKay et al. | |
| 4,966,235 | A | 10/1990 | Gregoli et al. | |
| 5,083,612 | A | 1/1992 | Ashrawi | |
| 5,083,613 | A | 1/1992 | Gregoli et al. | |
| 5,201,815 | A * | 4/1993 | Hong et al. | 166/245 |
| 5,246,071 | A * | 9/1993 | Chu | 166/245 |
| 5,350,014 | A | 9/1994 | McKay | |
| 5,400,430 | A | 3/1995 | Nenniger | |
| 5,860,475 | A * | 1/1999 | Ejiogu et al. | 166/245 |
| 6,068,054 | A | 5/2000 | Bragg | |
| 7,186,673 | B2 | 3/2007 | Varadaraj et al. | |
| 2003/0062159 | A1 * | 4/2003 | Nasr | 166/272.1 |
| 2007/0246426 | A1 | 10/2007 | Collins | |
| 2009/0306947 | A1 * | 12/2009 | Davidson | 703/2 |

OTHER PUBLICATIONS

PCT International Search Report and Written Opinion dated Mar. 17, 2010 for International Application No. PCT/US2009/059997.

Petroleum Production Handbook, vol. II: Reservoir Engineering, Society of Petroleum Engineers of AIME, Dallas, TX, 1962, pp. 19-2-19-3; 29-17-29-22.

(Continued)

*Primary Examiner* — Terry Melius
*Assistant Examiner* — Silvana Runyan
(74) *Attorney, Agent, or Firm* — John L. Wood

(57) ABSTRACT

Methods are provided for improving the production of heavy/viscous crude oil from subterranean formations. The methods include secondary production through use of a displacement fluid (typically a waterflood) wherein the subterranean formation is subjected to cyclic periods of overinjection of the displacement fluid followed by underinjection of the displacement fluid, but keeping the overall cumulative voidage replacement ratio (VRR) within a defined range, typically targeted to be about 1. In some aspects, the initial production of such heavy/viscous crude oil is limited, if possible, followed this cyclic secondary production methodology. By keeping the initial production, VRR, and cumulative VRR in defined ranges, the expected ultimate recovery (EUR) can be optimized, and overall production increased for example by as much as 100% or more relative to conventional production methods.

45 Claims, 8 Drawing Sheets

OTHER PUBLICATIONS

Vittoratos et al. "Optimizing Heavy Oil Waterflooding: Are the Light Oil Paradigms Applicable?" 1st Petroleum Society CIM World Heavy Oil Conference (Beijing, China), 2006-688, Nov. 12, 2006, pp. 1-11, XP009130489.

Vittoratos et al. "Flow Regimes of Heavy Oils under Water Displacement" 14th European Symposium on Improved Oil Recovery (Cairo, Egypt), B12, Apr. 22, 2007,-Apr. 24, 2007 XP009130405.

S.E. Buckley et al., "Mechanism of Fluid Displacement in Sands", AIME vol. 146, pp. 107-116, New York Meeting, Feb. 1941.

Craig, "The Reservoir Engineering Aspects of Waterflooding", American Institute of Mining, Metallurgical and Petroleum Engineers, Inc., Chapter 3, pp. 29-44, 1971.

Craig, "The Reservoir Engineering Aspects of Waterflooding", American Institute of Mining, Metallurgical and Petroleum Engineers, Inc., Chapter 8, pp. 78-96, 1971.

Calhoun, J. C., Jr., Fundamentals of Reservoir Engineering, University. of Oklahoma Press, Norman, pp. 371-376, 1960.

Uren, L. C., "Petroleum Production Engineering—Oil Field Exploitation", McGraw-Hill Book Co., Inc., New York, Toronto, and London, pp. 528-534, 1953.

Dyes, A. B. "Production of Water-Driver Reservoirs below their Bubble Point" JPT Oct. 1954, pp. 31-35.

* cited by examiner

METHOD FOR RECOVERING HEAVY/VISCOUS OILS FROM A SUBTERRANEAN FORMATION

REFERENCE TO RELATED APPLICATIONS

This application claims the benefit of U.S. Provisional Patent Application Ser. Nos. 61/104,563, filed Oct. 10, 2008, and 61/196,538, filed Oct. 17, 2008, the teachings of which are incorporated herein by reference in their entirety.

FIELD OF THE INVENTION

The present invention relates to methods for increasing recovery of heavy or viscous crude oil from a subterranean reservoir and, in embodiments, it is particularly concerned with cold flow operations associated with such reservoirs. In particular, according to one aspect of the invention, following an initial, but limited amount, of primary recovery of such oil, further oil is recovered by secondary displacement fluid operations, for example waterflooding, where periods of displacement fluid over-injection (VRR of ≧0.95) are followed by periods of displacement fluid under-injection (VRR of <0.95).

BACKGROUND OF THE INVENTION

In many light oil (32°-40° API gravity) reservoirs and some medium oil (20°-32° API gravity) reservoirs, the original oil in place (OIP) may be recovered in three stages. In an initial stage, usually termed primary production, oil typically flows from the wells due to the intrinsic reservoir pressure. Ordinarily, only a fraction of the original OIP is produced by this method, very roughly up to about 20% of the original OIP. Waterflooding, a secondary recovery technique, is typically the next stage in this sequence and yields additional oil, very roughly for example up to an additional 30% of the original OIP. After this point, the cost of continuing the waterflood usually becomes uneconomical relative to the value of the oil produced. Hence, as much as 50% of the original OIP can remain even after a reservoir has been extensively waterflooded. Tertiary recovery methods may be used in the last stage in the sequence. This stage may utilize one or more of any other known enhanced oil recovery methods; e.g., polymer flooding or $CO_2$ flooding.

Practices for waterflooding of conventional light oils were initially researched in the 1940's by Buckley et al. in "Mechanism of Fluid Displacements in Sands", AIME Vol. 146, pages 107-116 (1942) and little has changed since the work by Craig in "The Reservoir Engineering Aspects of Waterflooding" American Institute of Mining, Metallurgical and Petroleum Engineers, Inc. (1971). Even as recently as 2004, those in industry report that most of the sources refer to waterflooding oils of viscosity of less than 100 mPa·s, see e.g., Smith et al. "Waterflooding", Advanced Waterflooding Course, Society of Petroleum Engineers, Canadian Section, Calgary, Alberta (Apr. 19-23, 2004). The major precepts of classical light oil waterflooding have been: start early; and completely replace reservoir voidage (VRR=1). Maintaining an even VVR, i.e., a VRR of 1, is so ingrained in industry theory and practice today, that Canadian producers must get permission from government regulators to deviate the VRR from a value of 1. Chawathé et al. studied large Middle-Eastern waterfloods and have actually recommended a cumulative VRR of more than 1.2 for peripheral floods.

Oil recovery through use of secondary methods employing displacement fluids, such as waterflooding, is usually inefficient in subterranean formations (hereafter also simply referred to as formations) where the mobility of the in-situ oil being recovered is significantly less than that of the drive fluid used to displace the oil. Mobility of a fluid phase in a formation is defined by the ratio of the fluid's relative permeability to its viscosity. When the displacing fluid is water, the displacement typically becomes inefficient for oils with a viscosity of greater than, for example, 10 cp.

In particular, when waterflooding is applied to displace very viscous or heavy oil from the formation, the process is very inefficient because the oil mobility is so much less than the water mobility. As used herein, the term "viscous or heavy oil" means an oil of 30° API gravity or less, and generally less than 25° API. Some typical heavy oil reservoirs in the State of Alaska, USA or Canada can exhibit a gravity of less than 17° API.

Notwithstanding such inefficiency, waterflooding is becoming increasingly important in recovering heavy oil. In Western Canada, 5200 million $m^3$ of heavy oil is estimated to be in place in Alberta and Saskatchewan. However, only a fraction of this heavy oil is being recovered by more than 200 waterflood operations, with a typical recovery of about 24% of the reservoir's oil in place. An improvement in waterflooding these reservoirs of even a few percent could result in recognition of a substantially greater amount of recoverable reserves.

Consequently, in past waterflooding operations, it has been felt that there is a need to either make the water more viscous through use of particulates, polymers, or other chemical agents, or to use another drive fluid that will not "finger" as easily through the oil. Due to the large volumes of drive fluid needed, the proposed drive fluid must be inexpensive and stable under formation flow conditions. Oil displacement is most efficient when the mobility of the drive fluid is closer to or less than the mobility of the oil, so it would be advantageous to develop a method of generating a lower mobility drive fluid in a cost-effective manner. For modestly viscous oils—those having viscosities of approximately 20-100 centipoise (cp)—water-soluble polymers such as polyacrylamides or xanthan gum have been used to increase the viscosity of the water injected to displace oil from the formation. With this process, the polymer is dissolved in the water, increasing its viscosity.

While water-soluble polymers may be used to achieve a favorable mobility waterflood for relatively low viscosity oils, usually the process cannot economically be applied to achieving a favorable mobility displacement of more viscous or heavy oils. These oils are so viscous that the amount of polymer needed to achieve a favorable mobility ratio would usually be uneconomic. Further, as known in the art, polymer dissolved in water often is desorbed from the drive water onto surfaces of the formation rock, entrapping it and rendering it ineffective for viscosifying the water. This leads to loss of mobility control, poor oil recovery, and high polymer costs. For these reasons, use of polymer floods to recover oils in excess of 100 cp is not usually technically or economically feasible.

Other methods employ various chemical or particulate emulsifying agents or emulsions themselves for enhanced oil recovery, as can be seen in U.S. Pat. Nos. 2,731,414; 2,827,964; 4,085,799; 4,884,635; 5,083,612; 5,083,613; 6,068,054; and 7,186,673. While these methods may help increase the recovery of oil, they are relatively expensive and difficult to employ in practical use.

McKay, in U.S. Pat. No. 5,350,014, discloses a method for producing heavy oil or bitumen from a formation undergoing thermal recovery. Production is said to be achieved in the form of oil-in-water emulsions by carefully maintaining the temperature profile of the swept zone above a minimum temperature. Emulsions generated by such control of the temperature profile within the formation are thought to be useful for forming a barrier for plugging water-depleted thief zones in formations being produced by thermal methods, including control of vertical coning of water. However, this method requires careful control of temperature within the formation zone and, therefore, is useful only for thermal recovery projects. Consequently, the method disclosed by McKay could not be used for non-thermal (also referred to as "cold flow") recovery of heavy or viscous oil.

More recently, Vittoratos et al. in "Flow Regimes of Heavy Oils under Water Displacement" 14$^{th}$ European Symposium on Improved Oil Recovery, Cairo, Egypt (Apr. 22-24, 2007), describes an analysis of certain heavy oil waterflood data.

The relevant teachings of the patents and publications mentioned herein are incorporated by reference.

As can be seen, there is a need for improved methods of producing heavy or viscous oils from subterranean formations so that more of the OIP can be recovered therefrom, and particularly, there is a need for methods which can be implemented economically and that are capable of performing well under a wide range of formation conditions.

SUMMARY OF THE INVENTION

The above-described advantages may be attained by the present invention, which in embodiments is directed to methods for increasing recovery of heavy or viscous crude oil from a subterranean reservoir, and, particularly in some embodiments is concerned with cold flow operations associated with production from such reservoirs, wherein oil may be recovered by secondary displacement fluid operations, for example waterflooding, which cycle between periods of displacement fluid over-injection followed by periods of displacement fluid under-injection. In some embodiments, this cycling is conducted after an initial, but limited amount, of primary recovery of such oil by intrinsic pressure, i.e., pressure depletion. Without wishing to be bound by theory, it is believed that such operations, including use of the other embodiments as described hereinafter, results in formation of a desirable in-situ gas-in-oil foam and/or water-in-oil emulsion within the reservoir having a viscosity closer to that of the viscous or heavy oil being displaced. This may result in a more efficient and complete sweep of the reservoir and ultimately an increased recovery of oil.

As described in more detail in the specific embodiments that follow hereinafter, it is believed that operation within the defined parameters as described herein after may result in significantly improved expected ultimate recovery (EUR) factors relative to operation outside of such defined parameters, such as from 100% to 200% more than conventional production methods which do not limit initial primary production or cycle between periods of overinjection and underinjection.

Thus, in a first aspect, the invention is directed to a method of recovering oil and other formation fluids from a reservoir comprising an oil-bearing reservoir rock and having at least one production well and at least one injection well and conducting secondary production operations using a displacement fluid, and wherein the produced oil has a gravity in the range of ≦30° API. The method comprises the steps of:

(a) overinjecting the displacement fluid into the reservoir rock at a voidage replacement ratio (VRR) of from 0.95 to 1.11 until the produced fluids reach a water to oil ratio (WOR) of at least 0.25; and (b) underinjecting the displacement fluid into the reservoir rock at a VRR of <0.95 until the produced fluids have a gas to oil ratio (GOR) of at least 2 times the solution GOR of the initial oil produced from the well, wherein during water injection a cumulative VRR is maintained within a range of 0.6 to 1.25.

In embodiments, the method includes an additional step (c) wherein steps (a) and (b) are repeated one or more times.

In another aspect, the invention is directed to a method of recovering oil and other formation fluids from a reservoir comprising an oil-bearing reservoir rock and having at least one production well and at least one injection well and conducting secondary production operations using a displacement fluid, and wherein the produced oil has a gravity in the range of 17 to 30° API. The method comprises the steps of:

(a) producing 1 to 4% of the original oil in place (OIP) from the reservoir prior to commencing injection of the displacement fluid into the reservoir rock;

(b) overinjecting the displacement fluid into the reservoir rock at a voidage replacement ratio (VRR) of from 0.95 to 1.11 until the produced fluids have a water to oil ratio (WOR) of at least 0.25; and (c) underinjecting the displacement fluid into the reservoir rock at a VRR of <0.95 until the produced fluids have a gas to oil ratio (GOR) of at least 2 times the solution GOR of the initial oil produced from the well, wherein during displacement fluid injection a cumulative VRR is maintained within a range of 0.6 to 1.25.

In embodiments, the method includes an additional step (d) wherein steps (b) and (c) are repeated one or more times.

In another aspect, the invention is directed to a method of recovering oil and other formation fluids from a reservoir comprising an oil-bearing reservoir rock and having at least one production well and at least one injection well and conducting secondary production operations using a displacement fluid, wherein the produced oil has a gravity in the range of <17° API. The method comprises the steps of:

(a) producing up to 8% of the original oil in place (OIP) from the reservoir prior to commencing injection of the displacement fluid into the reservoir rock;

(b) overinjecting displacement fluid into the reservoir rock at a voidage replacement ratio (VRR) of from 0.95 to 1.11 until the produced fluids have a water to oil ratio (WOR) of at least 0.25; and (c) underinjecting displacement fluid into the reservoir rock at a VRR of <0.95 until the produced fluids have a gas to oil ratio (GOR) of at least 2 times the solution GOR of the initial oil produced from the well, wherein during displacement fluid injection a cumulative VRR is maintained within a range of 0.6 to 1.25.

In embodiments, this method includes an additional step (d) wherein steps (b) and (c) are repeated one or more times.

These and other aspects of the invention are described in more detail within the detailed description of the invention which follows hereinafter.

BRIEF DESCRIPTION OF THE DRAWINGS

The manner in which the objectives of this disclosure and other desirable characteristics are obtained is explained in the following description and attached drawings in which.

Figure 1:
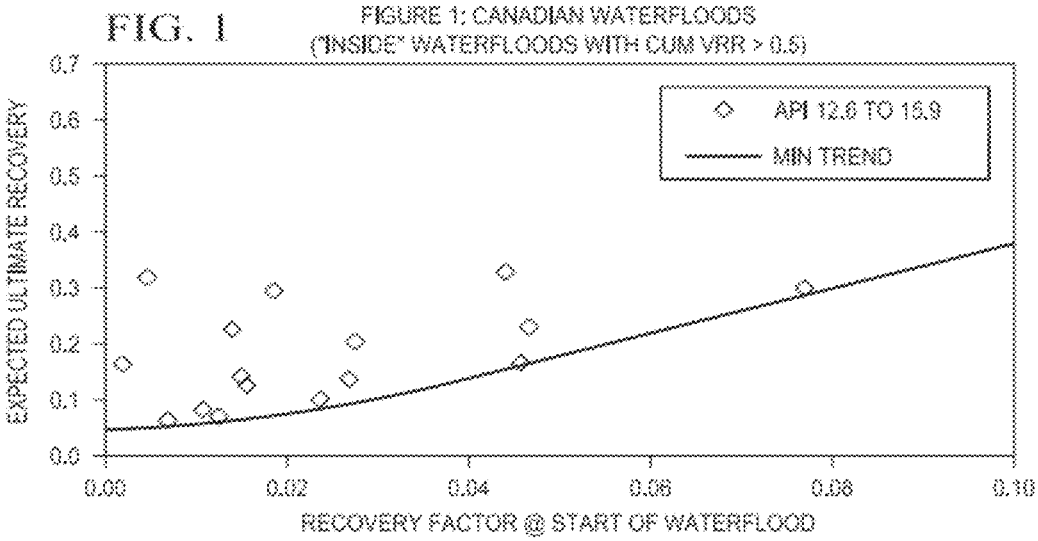
FIG. 1 is a graphical illustration of data for Example 1, wherein the x-axis is the Recovery Factor at the start of an inside waterflood and EUR is represented by the y-axis, but is limited just to the data for 12.6-15.9° API oil.
Figure 2:
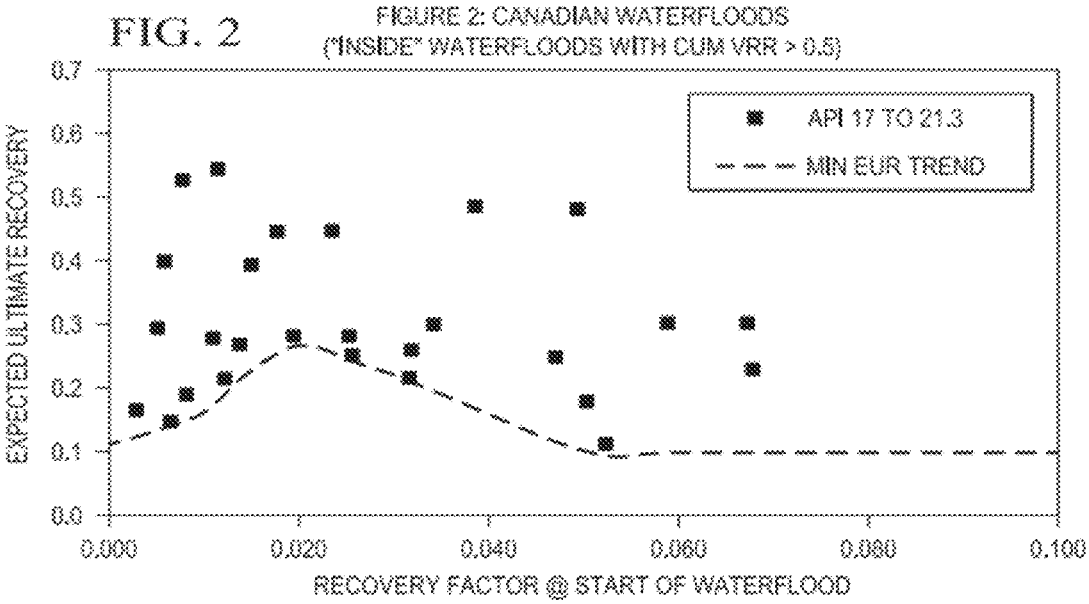
FIG. 2 is a graphical illustration of data for Example 1, wherein the x-axis is the Recovery Factor at the start of an inside waterflood and EUR is represented by the y-axis, but is limited just to the data for 17-21.3° API oil.
Figure 3:
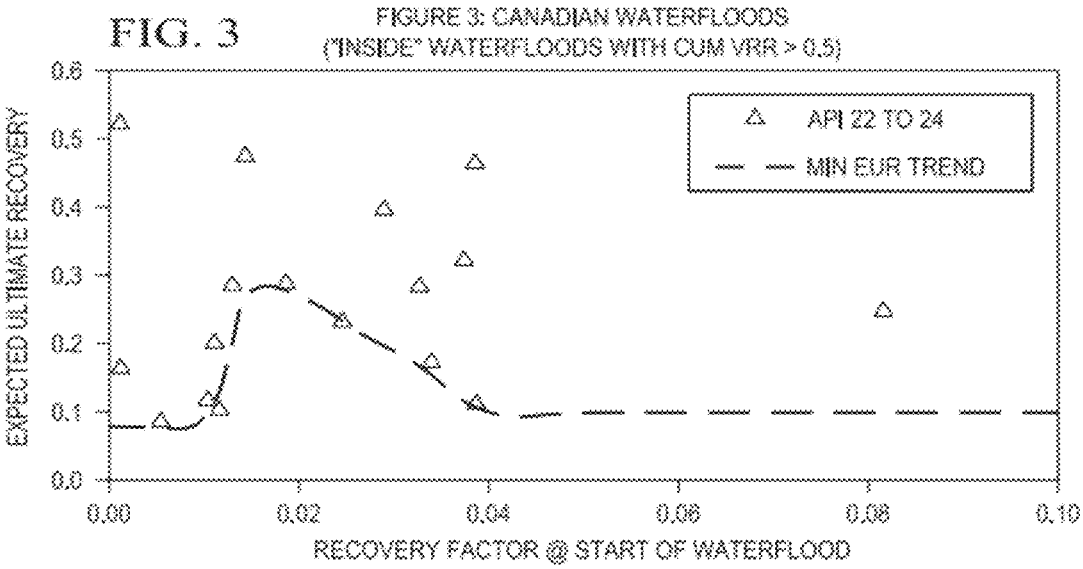
FIG. 3 is a graphical illustration of data for Example 1, wherein the x-axis is the Recovery Factor at the start of an inside waterflood and EUR is represented by the y-axis, but is limited just to the data for 22-24° API oil.
Figure 4:
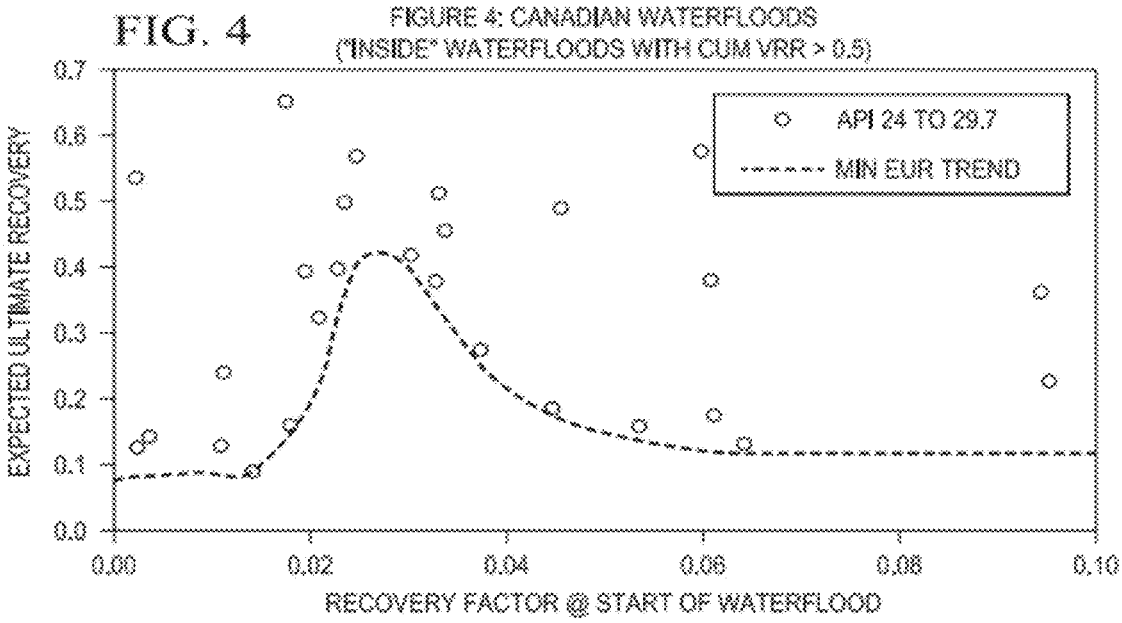
FIG. 4 is a graphical illustration of data for Example 1, wherein the x-axis is the Recovery Factor at the start of an inside waterflood and EUR is represented by the y-axis, but is limited just to the data for 24-29.7° API oil.

It is to be noted, however, that the appended drawings illustrate only embodiments of the present disclosure, and are therefore not to be considered limiting of its scope, for the invention herein may admit to other equally effective embodiments.

DETAILED DESCRIPTION OF THE INVENTION

In the following description, numerous details are set forth to provide an understanding of the disclosed methods. However, it will be understood by those skilled in the art that the methods may be practiced without these details and that numerous variations or modifications from the described embodiments may be possible.

The following definitions and terms are used:

Expected Ultimate Recovery ("EUR") means the stock tank volume of oil ultimately recovered divided by the stock tank volume of OIP in the reservoir at a temperature of 60° F. and 1 atmosphere pressure.

Reservoir thickness (h) means the thickness of the hydrocarbon-containing subterranean formation in feet (ft).

Inside flood means any type pattern or line drive waterflood and is discussed in the description of preferred embodiments hereinbelow.

Permeability of the reservoir is k in terms of milliDarcy (mD).

Oil In Place (OIP) means the original amount of oil in the reservoir prior to production.

Gas-Oil Ratio (GOR) means the ratio of gas dissolved in solution in terms of standard cubic feet at 60° F. and 1 atmosphere pressure (SCF) divided by the stock tank barrels of oil at 60° F. and 1 atmosphere pressure. GOR has units of SCF/BBL or $m^3$ gas/$m^3$ oil and is a well known term in the art, and is described for example, by Frick et al. in "Petroleum Production Handbook", Vol II, pages 19-2 and 29-17 to 29-22, Society of Petroleum Engineers of AIME, Millet The Printer, Inc. (Dallas, Tex. USA) 1962.

Solution GOR means the amount of gas in solution, or dissolved, in a liquid and is determined by PVT analytical procedures known in the petroleum engineering art, as is described for example, by Frick et al. in "Petroleum Production Handbook", Vol II, pages 19-3, Society of Petroleum Engineers of AIME, Millet The Printer, Inc. (Dallas, Tex. USA) 1962.

Outside flood means a peripheral waterflood and is discussed in the description of preferred embodiments below.

Recovery Factor (RF) means the stock tank volume of oil recovered in Barrels (BBL) divided by the stock tank of OIP in barrels (BBL), all at a temperature of 60° F. and pressure of 1 atmosphere. RF is the decimal equivalent of the percentage of OIP produced, as previously discussed.

Voidage Replacement Ratio (VRR) means the volume at reservoir conditions of displacement fluid (water) injected into the hydrocarbon reservoir in barrels (BBL) divided by the volume at reservoir conditions of fluids (oil, gas and water) produced from the reservoir in barrels (BBL).

Cumulative VRR (cum VRR) means the cumulative volume of injected fluid at reservoir conditions (in barrels) divided by the cumulative volume of produced fluids (oil, water, and gas) at reservoir conditions.

Viscosity (μ) is in terms of centipoise (cp).

Water/Oil Ratio (WOR) means the volume of water produced (in barrels) divided by the stock tank volume of oil produced at 60° F. and 1 atmosphere pressure.

Water cut means the volume fraction of water to the total liquid volume produced from a well.

The methods disclosed herein are directed to improving the production of heavy/viscous crude oil from subterranean formations. In some embodiments where little to no production from the reservoir has taken place, an initial primary production of a limited amount of the oil in place (OIP) from the reservoir is conducted first, and then followed by secondary production through use of a displacement fluid (typically a waterflood) wherein the subterranean formation is subjected to cyclic, i.e., alternating periods of overinjection of the displacement fluid followed by underinjection of the displacement fluid, but keeping the overall cumulative voidage replacement ratio (VRR) within a defined range, generally within a range of 0.6 to 1.25, and particularly from 0.93 to 1.11 as further described hereinafter.

In other embodiments, particularly where primary production may have already occurred, production from the reservoir may still be enhanced by this same cycling between a period of overinjection of the displacement fluid followed by a period of underinjection of the displacement fluid. It should be understood, however, that depending on reservoir conditions or prior operations where primary production has been conducted, the initial secondary production may employ an initial period of underinjection, particularly if the GOR of the produced fluids at the start of the secondary production is excessive, such as greater than the solution GOR of the reservoir. Thus, it should be understood that the invention should not be limited only to initial periods of overinjection.

By varying the displacement fluid injection rate but also keeping the cumulative VRR between the range previously described, i.e., and particularly targeted to a cumulative VRR of around 1.0, the expected ultimate recovery (EUR) can be increased as much as 100% or more relative to conventional production methods which try to maximize the initial primary production of hydrocarbons and thereafter seek to only to balance the volume of water injection with the volume of hydrocarbons, gases and water being produced.

The present invention therefore comprises use of a secondary recovery method wherein a displacement fluid, typically water or other aqueous fluid, is injected into a subterranean formation for purposes of enhancing production of hydrocarbons present within the formation. Such as method is typically referred to within the art as "waterflooding" or a "waterflood" operation. Waterflooding is known to include a collection of operations in an oil field used to support reservoir pressure at one or more extraction wells ("producers") and enhance oil recovery through a system of one or more wells injecting water or other fluids ("injectors"). The waterflooding process uses fluid injection to transport residual oil remaining from initial primary oil production to appropriate producers for extraction. In this manner, wells that have finished primary production can continue to produce oil, thereby extending the economic life of a well field, and increasing the total recovered oil from the reservoir.

The present invention may be carried out utilizing injection and production systems as defined by any suitable arrangement of wells. One well arrangement commonly used in waterflooding operations and suitable for use in carrying out the present invention is an inside or integrated five-spot pattern and also other pattern types as described in U.S. Pat. No. 4,018,281, the teachings of which are incorporated herein by reference in their entirety. The pattern may comprise a plurality of five-spot patterns, each of which comprises a central production well and four peripheral injection wells as indicated in this patent.

Of course, other patterns and well arrangements may be used in carrying out the present invention such as direct or staggered line drive patterns, four-spot, seven-spot, or nine-spot patterns, outside, or circular flood patterns. For further description of these and other well arrangements which may be employed in waterflooding, reference is made to Calhoun, J. C., Jr., FUNDAMENTALS OF RESERVOIR ENGINEERING, Univ. of Oklahoma Press, Norman (1960), pp. 371-376, and Uren, L. C., PETROLEUM PRODUCTION ENGINEERING—OIL FIELD EXPLOITATION, McGraw-Hill Book Co., Inc., New York, Toronto, and London (1953), pp. 528-534. It should be understood that the invention may be carried out utilizing dually completed injection-production wells of the type disclosed, for example, in U.S. Pat. No. 2,725,106 to Spearow also incorporated by reference herein. This arrangement may sometimes be utilized to advantage in relatively thick reservoirs in which it is desirable to displace the oil in the reservoir upwardly and recover the oil from the upper portion of the reservoir. Outside patterns are especially of interest for use with overinjection of displacement fluids according to the invention.

As mentioned, the invention is directed to production of so-called heavy or viscous crude oils, which typically have an API gravity of 30° API or less, particularly 25° API or less. It is believed, without wishing to be bound by theory, that crude oils having an API gravity of 30° API or less promote formation of a gas-oil foamy emulsion and/or water-in-oil emulsion when a displacing fluid, such as water, is used according to the methods described herein.

An important initial step in the methods of the invention is the primary production, i.e., production by way of intrinsic pressure, of a limited amount of the OIP within the subterranean formation, the amount being dependent upon the API gravity of the crude oil within the formation. However, as mentioned above, the cycling between periods of overinjection and underinjection, or underinjection and overinjection, depending upon the conditions within the reservoir at the start of secondary production, is still advantageous and may result in enhanced oil recovery from the reservoir.

For example, where an initial limited primary production takes place, if the crude oil being produced has an API gravity of from 17 to 30° API, then initial production of the OIP is suitably from 0.05 to 5% of OIP (a Recovery Factor of 0.005 to 0.05), particularly from 1 to 4% of the OIP (a Recovery Factor of 0.01 to 0.04), and more particularly from 1.5 to 3% of the OIP (a Recovery Factor of 0.015 to 0.03). For heavier crudes, including bitumin, with an API gravity of <17° API, and particularly from 12 to 16° API, the initial production by primary means is less critical and may be maintained to 8% of the OIP or less (a Recovery Factor of 0.08 or less). These values are illustrated and described in more detail within the examples of the invention described hereinafter.

In particular, the present invention has application in an number of areas around the world with heavy/viscous oil deposits, such as Canada, USA (Alaska), Venezuela, Brazil, and Russia. It is particularly applicable to use for reservoirs comprised of heavy/viscous crudes with a kh/μ of 1.4 to 100 mD-ft/cP, such as seen in many Alaskan reservoirs bearing viscous/heavy oil, but it should be understood that this invention is not limited for use in reservoirs with a kh/μ within this range.

After an initial production of the heavy/viscous crude oil by primary production, secondary production begins, typically conducted as a waterflood. Although the term waterflood is used herein, it should be understood that other known displacement fluids may be used, such as light hydrocarbons (natural gas streams).

Initially, the waterflood may begin with a period of so-called overinjection, i.e., a voidage replacement ratio (VRR) of generally ≧0.95, such as from 0.95 to 1.11, and particularly 0.95 to 1, or even higher may be used until the cumulative VRR (based on initial oil production) reaches or is maintained from 0.6 to 1.25, in embodiments it is from 0.93 to 1.11, and in some more particularly targeted to around 1, such as from 0.95 to 1.05. This overinjection continues until WOR increases to an undesired level, such as a WOR of at least 0.25, particularly at least 0.4, and more particularly at least 0.75. Operation to maintain the cumulative VRR targeted to around 1 is desired, so that excessive amounts of displacement fluid are not injected into the formation.

After reaching an undesired WOR level, a period of so-called underinjection is employed next, i.e., operation of the waterflood at a VRR of less than 0.95, with less than 0.90 being useful too, and particularly from 0.5 to 0.85, and more particularly from 0.6 to 0.8 so as to liberate gas contained within the formation fluids and obtain optimal EUR results. Below a VRR of 0.5, it is believed that any in-situ emulsion that results will not operate as effectively in the waterflood operation. During the underinjection period, the cumulative VRR is desirably maintained from 0.6 to 1.25. Additionally, the underinjection is continued until an undesired amount of gas is liberated and produced, such as when the GOR of the produced fluids reaches a level of at least 2 times the solution GOR of the reservoir, and in some embodiments, at least 5 times the solution GOR. The actual level will depend on the particular reservoir, how quickly the operator desires to deplete reservoir pressure, and also economics of producing the reservoir.

Operation of the waterflood from a period of overinjection to a period of underinjection is cyclic in nature, i.e., this may then be repeated one or more times, and particularly a plurality of times as is economical for efficient production of the heavy/viscous crude oil.

It is also important to limit the amount of water injected during the periods of underinjection, i.e., when the VRR is less than 0.95. Generally, for oil with a gravity of 17 to 30° API, the cumulative volume of water injected during such periods of underinjection is from 15 to 30%, based on the total cumulative volume of water injected to the formation. For oil with a gravity of <17° API, the cumulative volume of water injected during such periods of underinjection is from 30 to 50%, based on the total cumulative volume of water injected to the formation.

Specific Embodiments of the Invention

A statistical study of 166 western Canadian waterfloods recovering heavy and medium gravity oils was conducted and new operating practices for heavy oil waterflooding were developed. In classical light oil waterflooding, operators typically advise to start waterflooding early and maintain the voidage replacement ratio (VRR) at 1. The study, however, produced surprising results for 2 parameters—among the 120 reservoir and operating parameters investigated—that ran counter to the recommended practices of classical light oil waterflooding. Delaying the start of waterflooding until a certain fraction of the original oil in place was recovered was found to be beneficial. Secondly, varying the VRR was shown to correlate with increased ultimate recovery—periods of underinjection are needed, although a cumulative VRR of around 1 should be maintained.

Ultimate recovery was correlated with the primary recovery factor at the start of the waterflood. When the dataset is analyzed by ranges of API, a "sweet spot" of improved ultimate recovery was observed in a very narrow window of oil recovery factor prior to the start of waterflooding. Graphs of each category show this "sweet spot" window where improved recovery occurs.

Also increases in ultimate recovery were observable when examining graphs of ultimate recovery versus the fraction of injection volume that was underinjected—but again, only when the data is analyzed by the ranges. A certain period of injection when the VRR was less than 0.95 resulted in increased ultimate recoveries. However, it is important that this period of VRR<0.95 be offset with periods of increased VRR so that the cumulative VRR is around 1.0. Again, each range manifested a narrow "sweet spot" for where this increase in ultimate recovery occurred.

Production data, well numbers and pattern development information were obtained and studied for 166 fields in Western Canada using ACCUMAP exploration and evaluation software available from HIS Energy of Englewood, Colo., USA and GeoQuest Merak PETRODESK software and production databases (Canadian production database) available from Schlumberger Oilfield Services of Houston, Tex., USA. Reservoir data were also obtained from two Canadian Provincial governmental data bases—Government of Saskatchewan, Ministry of Industry and Resources (Reservior Annual 2003) and Government of Alberta, Alberta Energy and Utilities Board, Alberta's Energy Reserves 2005 and Supply/Demand Outlook 2005-2015, ST 98-2006. The study was limited to waterfloods on oil pools producing oil of gravity less than 30° API. Since only the effects of primary production and injection strategy were of interest, data from operations that included waterfloods employing other enhanced oil recovery (EOR) schemes; small waterfloods (fewer than four injectors run by one operating company); and those oil pools which showed a discrepancy between ACCUMAP software and provincial production data was excluded.

Average permeabilities for each reservoir were calculated as the geometric mean (prorated by sample length) of air permeabilities from ACCUMAP software provided core data. Permeabilities (k) below 5 mD were deemed to be below the cut-off and excluded. Viscosity data was obtained from documents published by the Saskatchewan and Alberta provincial regulatory bodies, or estimated by developing a correlation between the oil gravity and the live viscosity for the available data. The viscosities were checked against a correlation for viscosity based on Alaskan heavy oil which uses oil gravity, GOR, reservoir temperature and pressure.

Three factors which could impact recovery from the reservoirs were calculated:

- The fraction of the original oil in place produced prior to the start of waterflooding;
- The overall cumulative VRR;
- The fraction of injected water volume that was underinjected (when the VRR<0.95).

To obtain the fraction of underinjection, the average annual VRR was calculated from the annual injection and production volumes. The cumulative injection volume for when the VRR was below 0.95 was divided by the cumulative water injected. This provided a quantification of the time the reservoir offtake and injection were out of balance and is a measure of the degree of underinjection. Different cut off values of VRR were evaluated and 0.95 proved to be the best delineator. This factor helps identify a reservoir with fluctuating VRRs throughout its life as opposed to a waterflood where the VRR is virtually constant.

The waterfloods varied in age from 1 to 50 years. However, waterfloods less than 12 years old were excluded from the statistical analysis. Waterfloods that have more than 12 years flooding history have the same statistical expected ultimate recovery (EUR), while ones with less than 12 years of water injection show a statistical increasing EUR up to 12 years of flooding. Removing the less mature floods is believed to eliminate erroneously low estimations of EUR from immature waterfloods.

In an effort to determine trends, the data was divided into differing ranges and groupings as follows:

Gravity

1)<17 API 2) 17 to 23 API

3)>23 API

Kh/μ (1.2 to 100 mD-ft/cP—the range for Alaska heavy oil reservoirs under development)

Field performance was divided into two categories:

1) inside waterfloods was the term used to describe cases in which the injectors are completely surrounded by producers and basically the water is injected "inside" the oil accumulation. It was observed in the study that all types of pattern waterfloods: 9-spots, inverted 9-spot, 5-spots, 7-spots, and irregular patterns, as well as variations of line drives performed similarly on all of the parameters evaluated. Therefore, these various flood patterns were grouped into a single grouping of inside waterfloods.

2) outside was the term used to describe waterfloods where the water is injected outside or peripheral to the oil accumulation.

The categories "inside" or "outside" reflect a description that can be applied to every waterflood. "Inside" waterfloods statistically have lower EUR's than "outside" waterfloods. Also "inside" waterflood EURs tend to suffer when the VRR>1.0, whereas "outside" waterfloods reflect increasing EUR's when the VRR>1.0. In "inside" waterfloods where the VRR>1.0, the injected water has to travel through oil and bypass recoverable oil to escape the reservoir; however, in an "outside" or peripheral flood the water required to balance the offtake is drawn into the oil reservoir and the extra injected water can escape to the periphery without inflicting damage on the EUR.

Example 1

Effect of the Amount of Primary Production (% OIP)

FIGS. 1-4 show the relationship between EUR and the amount of primary production, expressed as a fraction of OIP. Attention was directed firstly to 90 inside waterfloods.

Figure 5:
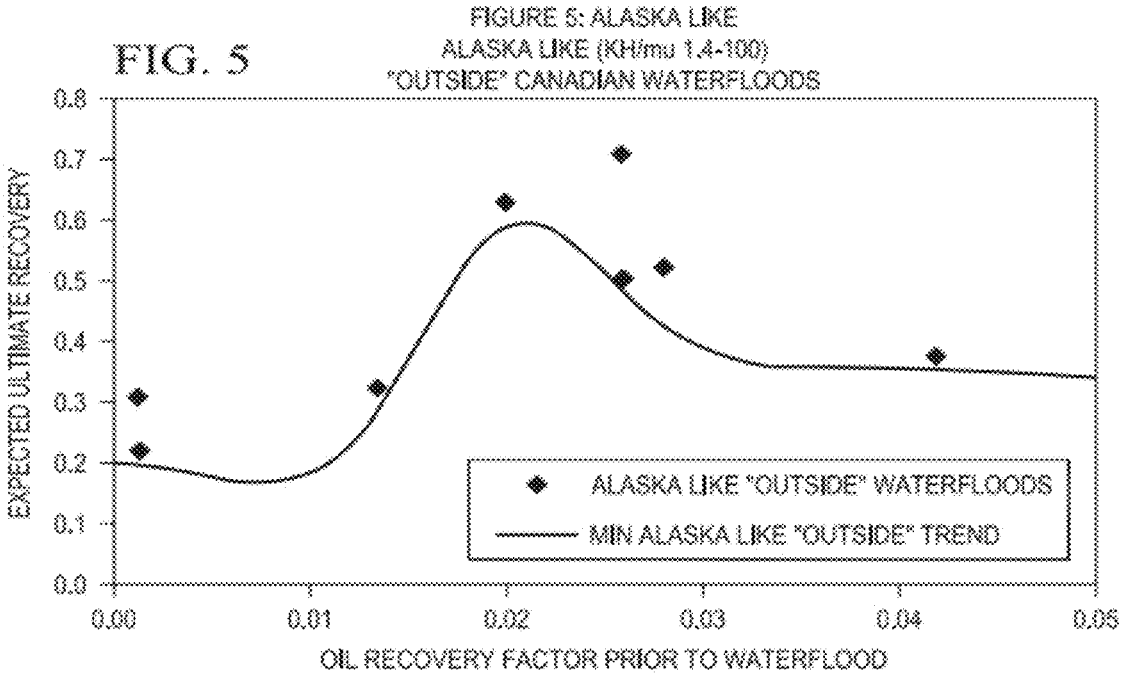
FIG. 5 is a graphical illustration of data for Example 1, wherein the x-axis is the Recovery Factor at the start of an outside waterflood for Alaska-like Canadian fields having a kh/μ of 1.4-100 mD-ft/cP and EUR is represented by the y-axis. The curve illustrates a sweet spot for optimal EUR, generally at a Recovery Factor of from about 0.0075 to 0.04 or an initial production of from 0.75 to 4% of the OIP.

FIGS. 1-4 show subsets of the combined dataset of 90 inside waterfloods: these are, respectively, waterfloods producing oil<17° API; between 17 and 22° API; between 22 and 24° API; and between 24 and 30° API. Rather than drawing a least-squares best fit line or curve through the data points in each graph, attention was directed to the minimum EUR experienced for each data set. These minimum-trend curves manifest an interesting pattern. With the exception of the heaviest oil (<17° API) waterfloods in FIG. 1, the minimum-trend curves in FIGS. 2 to 4 each show a "sweet spot" where the minimum EUR increases to a maximum value. This generally occurs with a pre waterflood production of from about 1 to 5% of the OIP, and more distinctly from 1.5 to 2.5% of OIP. There are fewer data points available for the outside waterfloods (FIG. 5), but there is an analogous graph for outside waterfloods of Alaska-like range (API between 17 and 23° API) showing the same type of "sweet spot" at pre-waterflood recovery for about 2% recovery of the original OIP prior to the initiation of the waterflood.

Figure 6:
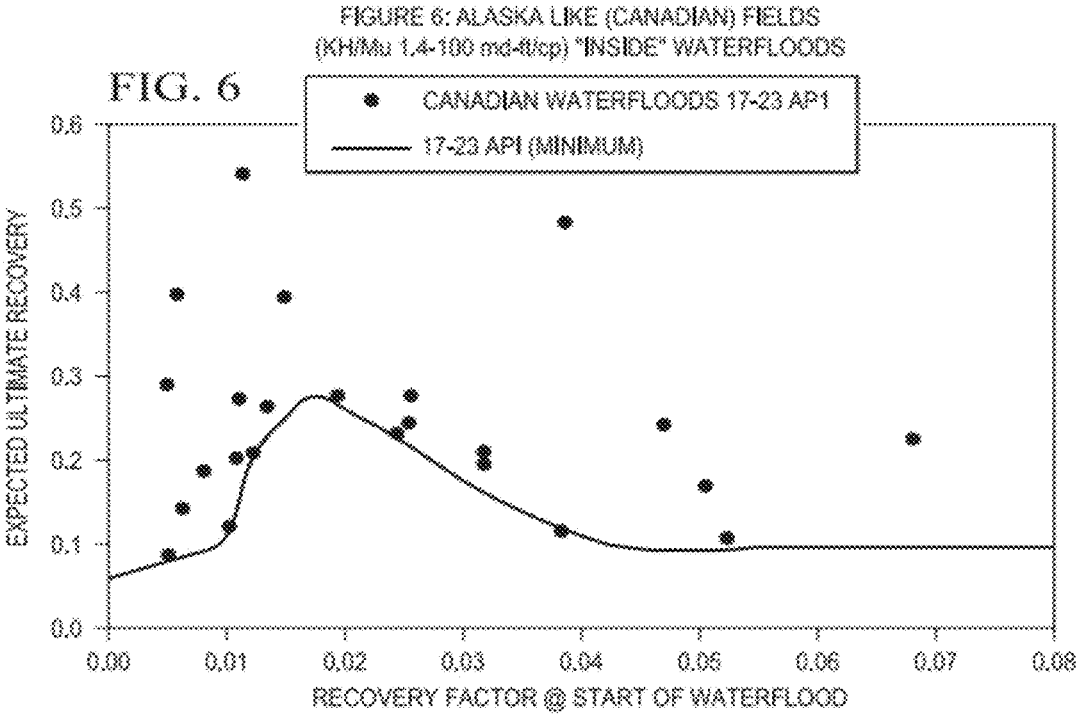
FIG. 6 is a graphical illustration of data for Example 1, wherein the x-axis is the Recovery Factor at the start of an inside waterflood for Alaska-like Canadian fields having a kh/μ of 1.4-100 mD-ft/cP and EUR is represented by the y-axis. The data points are for 17-23° API oil production. The "minimum" or solid line illustrates the minimum EUR that can be expected at varying recovery factors at the start of a secondary waterflood. The curve illustrates a sweet spot for optimal EUR, generally at a Recovery Factor of from about 0.01 to 0.04, or an initial production of from 1 to 4% of the OIP.
Figure 7:
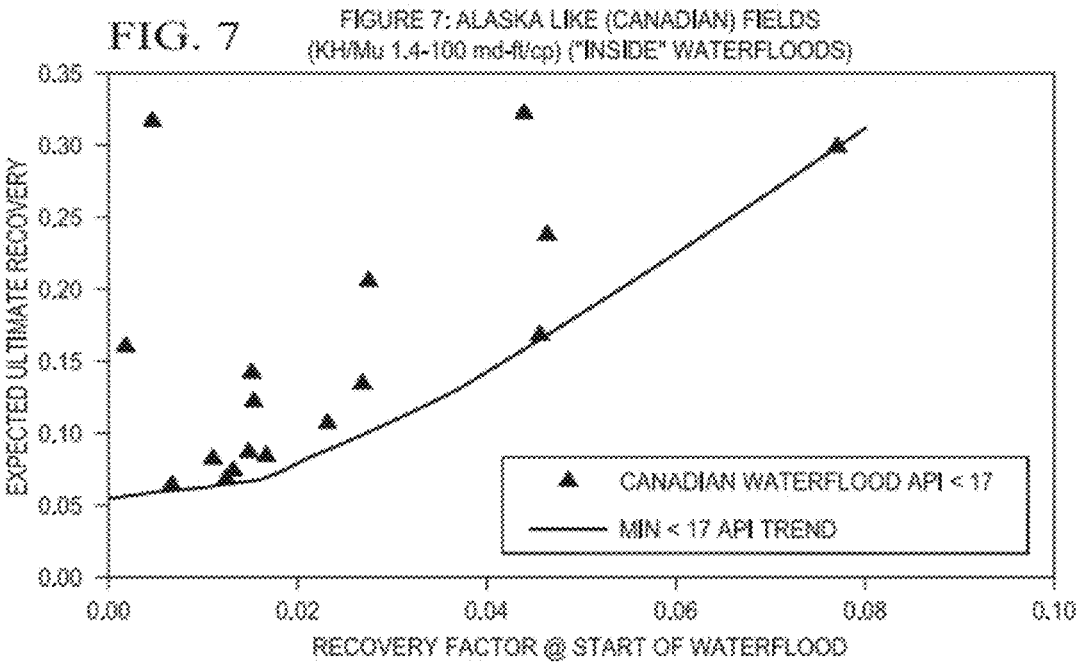
FIG. 7 is a graphical illustration of data for Example 1, wherein the x-axis is the Recovery Factor at the start of an inside waterflood for Alaska-like Canadian fields having a kh/μ of 1.4-100 mD-ft/cP and EUR is represented by the y-axis. The data points are for <17° API oil production. The solid line curve illustrates that production prior to waterflooding is not detrimental to EUR.

The increase in minimum EUR trend is observed with pre production of 1.5-3.0% of the oil in place prior to the initiation of the waterflood in the Alaska-like (Canadian) Waterfloods range of [permeability*pay/viscosity (kh/μ 1.4-100 mD-ft/cP)] for 17-23° API oil (FIG. 6). However, for reservoirs with <17° API (FIG. 7) production prior to the initiation of waterflooding is not apparently detrimental to the EUR. The "outside" peripheral waterfloods show the sweet spot in EUR with 1.5-2.5% of the oil in place produced prior to initiation of the waterflood, although the fewer number of points for this case reduces the certainty of pre-production of 2% of OIP before waterflooding commences—see FIG. 8.

Example 2

Effect of Injection Volume (VRR)

Figure 8:
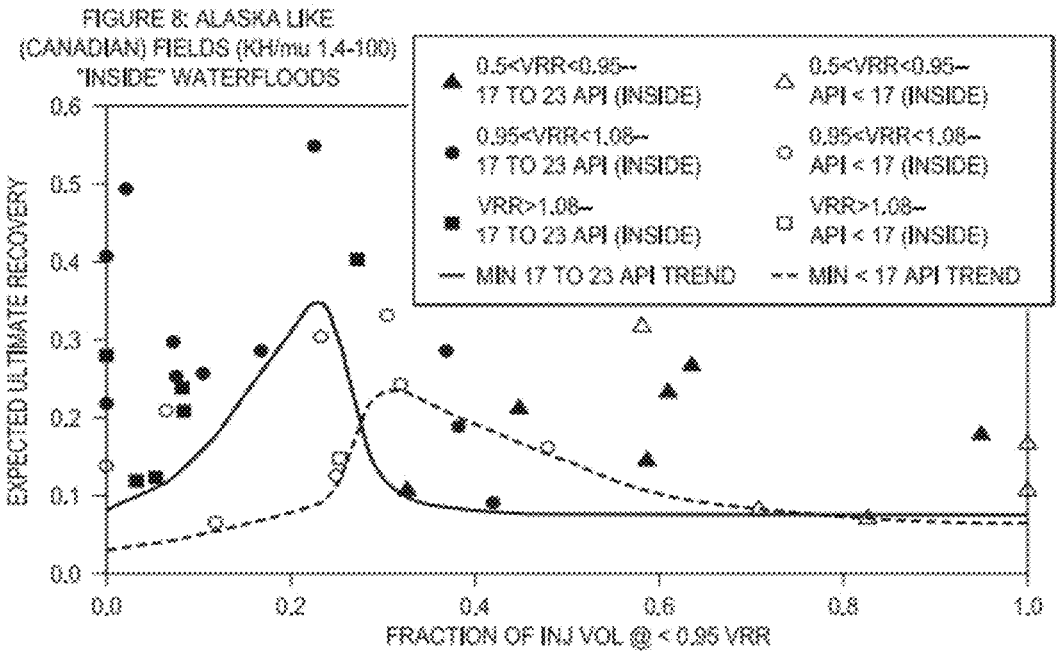
FIG. 8 is a graphical illustration of data for Example 2, wherein the x-axis is the Fraction of Injected Volume at <0.95 VRR for an "inside" waterflood for Alaska-like Canadian fields having a kh/μ of 1.4-100 mD-ft/cP and EUR is represented by the y-axis. The curve associated with the 17-23° API oil production illustrates a sweet spot for optimal EUR, generally where the Fraction of Injected Volume is between 0.1 to 0.3, and the curve associated with the <17° API production shows a similar increase in EUR in the range of from 0.25 to 0.6.
Figure 9:
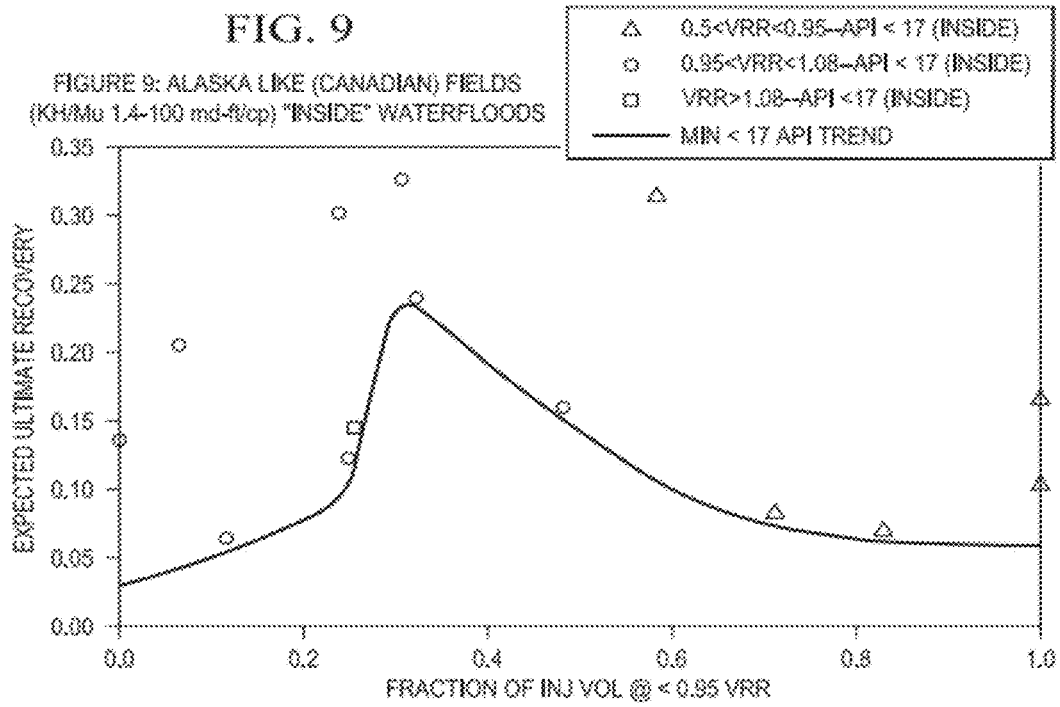
FIG. 9 is a graphical illustration of data for Example 2 for production of <17° API crude.
Figure 10:
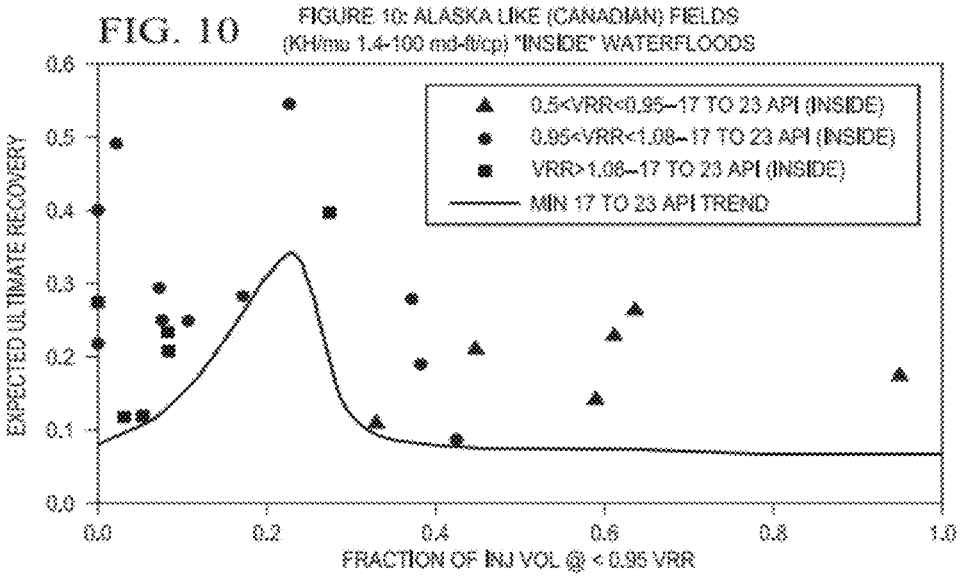
FIG. 10 is a graphical illustration of the data for Example 2 for production of 17-23° API crude.

FIG. 8 shows there is a correlation between the fraction of underinjection of the reservoir and the EUR. The x-axis parameter is the volume weighted injection fraction when the VRR is less than 0.95. FIG. 8 is a graph for the "Inside" Alaska-like (Canadian) waterfloods where the kh/μ is 1.4-100 mD-ft/cP. The sweet spot of increased minimum EUR's observed when the fraction of injection is less than 0.95 is similar to the sweet spot increases in the minimum EUR seen with the fraction of oil recovery prior to the initiation of waterflooding (FIGS. 1-6). In both cases there is an optimum sweet spot window of EUR. By investigating inside waterfloods and grouping the data by API, a sweet spot of an increase in the minimum EUR is observed. See FIG. 9 for <17° API and FIG. 10 for 17 to 23° API. FIG. 9 shows that even the heaviest oils (API gravity<17°) have an increase in the minimum EUR recovery trend curve when 30 to 50% of the injection occurs with the VRR<0.95. The sweet spot for the "Inside" Alaska-like Canadian waterfloods of 17-23° API and kh/μ 1.4 to 100 mD-ft/cP (FIG. 10) shows a similar increase in EUR occurs when the VRR<0.95 for between 15 to 30% of the cumulative injection volume.

Example 3

Effect of Cumulative VRR

Figure 11:
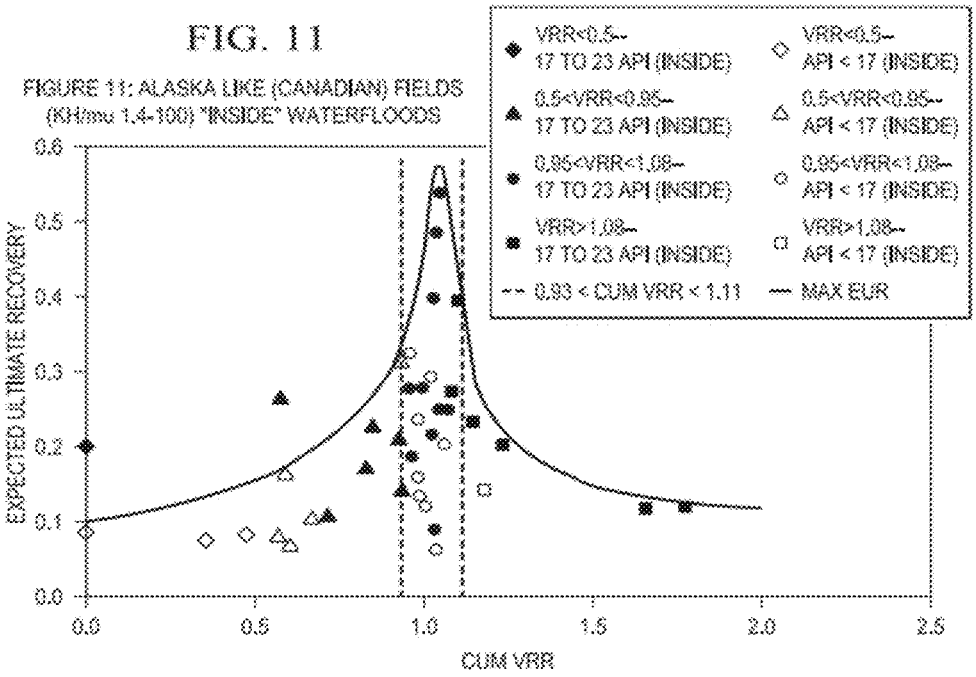
FIG. 11 is a graphical illustration of data for Example 3 showing EUR versus the cumulative VRR wherein enhanced EURs may be obtained at a cumulative VRR of from 0.6 to 1.25, and particularly from 0.93 to 1.11.

It is important to distinguish the recommendation of periods of underinjection from overall underinjection. FIG. 11 graphs the EUR vs. cumulative VRR for a variety of "inside" waterfloods. A cumulative VRR range of from 0.6 to 1.25 shows generally better EUR than waterfloods outside of this range, while a cumulative VRR of 0.93 to 1.11 shows significantly better EUR than waterfloods with cumulative VRR<0.93 or a cumulative VRR>1.11. Thus, while this data from Example 2 suggests that periods of underinjection will benefit heavy oil waterfloods, the data from Example 3 suggests that the overall cumulative VRR needs to be balanced for optimum results. For example, a flood which has a fraction of underinjection volume of 20% would inject, say, 20,000 $m^3$ of water at a VRR<0.95 and 80,000 $m^3$ of water injection at a VRR>0.95, with the injection volume for the VRR>0.95 being sufficient to make the overall VRR~1.0.

Example 4

Remediation of Rising WOR by Operation at VRR<1

Initially, the advantage of displacing oil with water using a VRR of less than one is demonstrated in the laboratory. A five foot long container with a cross-section of 10 inches by 10 inches is filled with 4 Darcy sand and saturated with water. The water saturation is then reduced to residual conditions by displacement with oil taken from an oil-bearing Alaskan formation having an API gravity of less than 20. Produced water from the same formation is injected into one end of the container and oil, water and gas were produced from the other end of the container five feet away. The oil employed is saturated with methane gas at 1400 pounds/square inch (psi) and the oil has an initial solution GOR of 35 $m^3$ gas/$m^3$ oil. The initial starting pressure is 1500 psi, and room temperature, i.e., 22° C. A procedure is developed to initially create a reproducible communication path from the input location to the output location of the container. Upon creation of the communication path, the subsequent water injection rate and fluids production rate are controlled to create different VRRs, in Run "A" the VRR is 1.0 and in Run "B" the VRR is adjusted to 0.7. In each run, the water injection rate is continued for about 35 hours. Initially, the WOR in each run is 0. Data obtained from each run is illustrated in FIG. 12.

Figure 12:
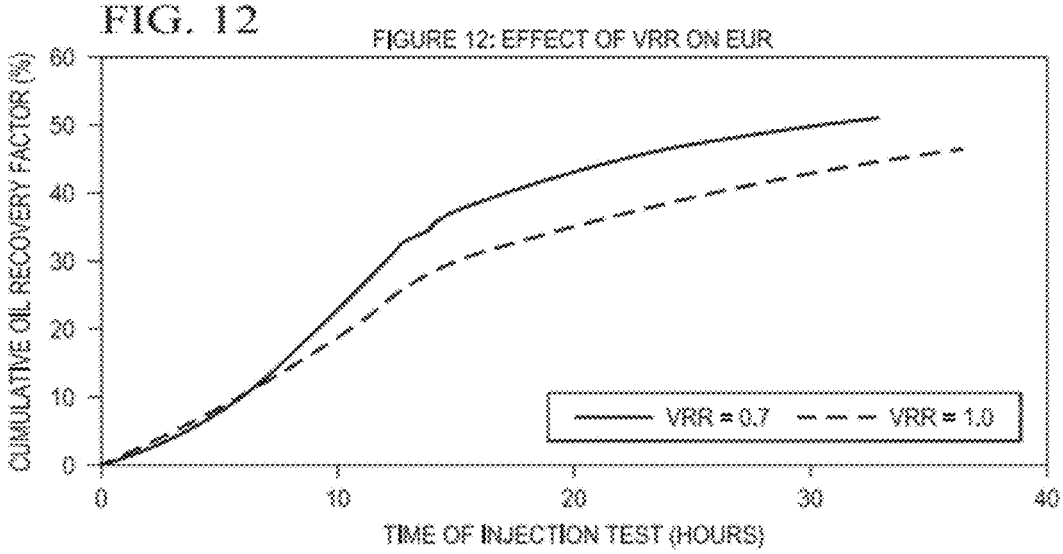
FIG. 12 is a graphical illustration of data for Example 4 showing a significant improvement in oil recovery for a viscous/heavy 20° API oil at a VRR of 0.7 in comparison to a VRR of 1.

FIG. 12 illustrates the reproducible behavior of the initial communication path, created in the first seven hours, for Runs A and B. In these runs, the injection rate is maintained constant at one liter per hour for the life of each run. Initially, the production rate for each run is maintained also at one liter per hour; however, after seven hours in Run "A" the production of fluids is maintained at the same one liter per hour rate (a VRR=1), while in Run B the production of fluids is increased to 1.4 liters per hour (a VRR=0.7). From FIG. 12, it is seen that a 20% higher cumulative recovery is achievable with a VRR=0.7. This is a significant improvement in recovery with essentially no incremental expenses.

In accordance with the invention, production of the field may be conducted at a VRR of 1 for a period of time until the WOR exceeds 1. At this point, the VRR is adjusted to a VRR of 0.7 and this operation is maintained until the GOR reaches a pre-determined level, for example less than 10 times the initial solution GOR, and more typically from 2-3 times the initial solution GOR. At this point, the VRR is adjusted again to a VRR of 1 and maintained at that level until the WOR exceeds 1 again, at which point the VRR is again adjusted to a VRR of 0.7 and so on. This cycling of operation from a VRR of about 1 or more to a VRR of less than 0.95 (such as 0.7) continues until the intrinsic energy of the reservoir is sufficiently used and enhanced recovery is no longer obtained. Thereafter, other methods may be used to obtain further recovery of oil.

Example 5

Application to a Field Comprised of Hydraulic Units

A field comprised of a plurality of hydraulic units that are each hydraulically isolated from each other is next subjected to a waterflood having cyclic periods of overinjection and underinjection according to the invention. The oil in each unit is similar in that it ranges from 18-22° API. The permeability of the main reservoir bearing rock is 100-150 mD and the kh/μ is 2.5 to 100.

Hydraulic Unit (HU-10) is one of a number of such hydraulic units used in the test, and it consists of 10 producer wells and 8 dual tubing string injector wells, plus 4 single tubing injector wells with multiple intervals of injection. The projected recovery factor is 16% of OIP. The producers have dual laterals with each lateral being 3,000 to 5,000 feet in length. These are completed in a reservoir at a depth of 4000 feet true vertical depth (TVD) and a reservoir temperature of 75-80° F. with a viscosity of 20-100 cp. Between two producers with their laterals about 2,000 feet apart there are two vertical injector wells. The injector wells are completed with long and short tubing strings. This permits control of the water injection into each interval.

Figure 13:
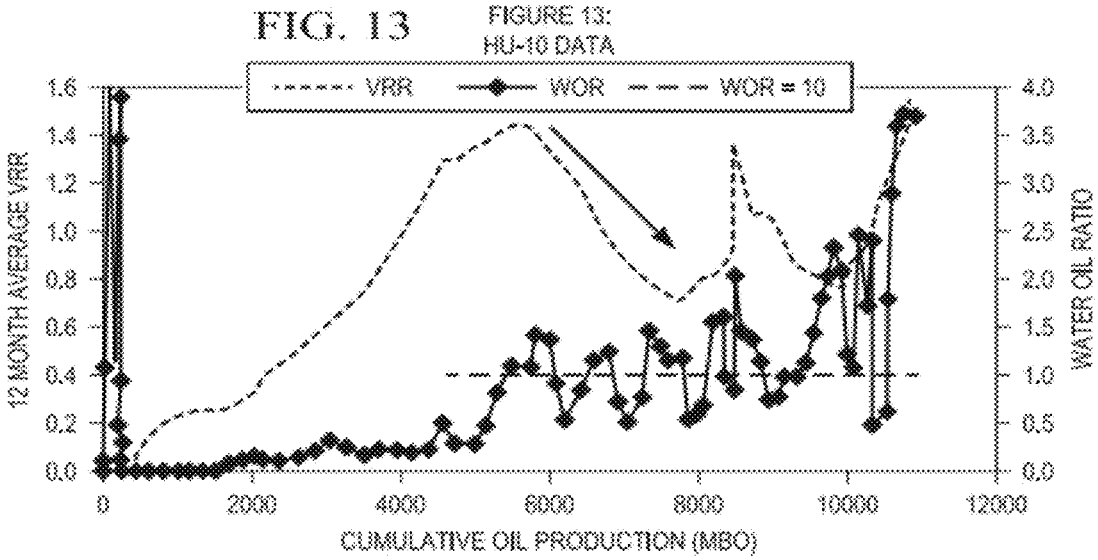
FIG. 13 is a graphical illustration of data for Example 5 wherein the solid line is a graph of VRR (rolling average) versus cumulative oil production (in terms of 1,000s of barrels of oil or "MBO"), and the solid line with diamond shaped data points represents a graph of WOR versus the same cumulative oil production.

Production data for HU-10 is shown in FIG. 13. The reduction of the VRR (an underinjection period wherein a VRR of <0.95 is employed) after a cumulative production of about 5500 MBO, which is coincident with stabilization of the water cut at about 0.5, is necessitated because of early water breakthrough exacerbated by use of initially high water injection rates when cumulative production is less than 5000 MBO in an effort to reach a Cumulative VRR of 1.0. The initial high injection rates result in VRR>1.0 and it is achieved by injecting above the fracture gradient. However, the injector started to break through to the producers prematurely, and the operation of the field is then modified according to an aspect of the invention to mitigate this problem. The curves show that by operation after the initial period of overinjection (average VRR of up to about 1.4), followed by a period of underinjection (average VRR down to 0.6 as illustrated by the arrow in FIG. 13) and then returning to a period of overinjection (average VRR up to 1.35), allows for the WOR to stabilize and fluctuate around at a water cut of 50% for cumulative oil production of greater than 5500 MBO.

Figure 14:
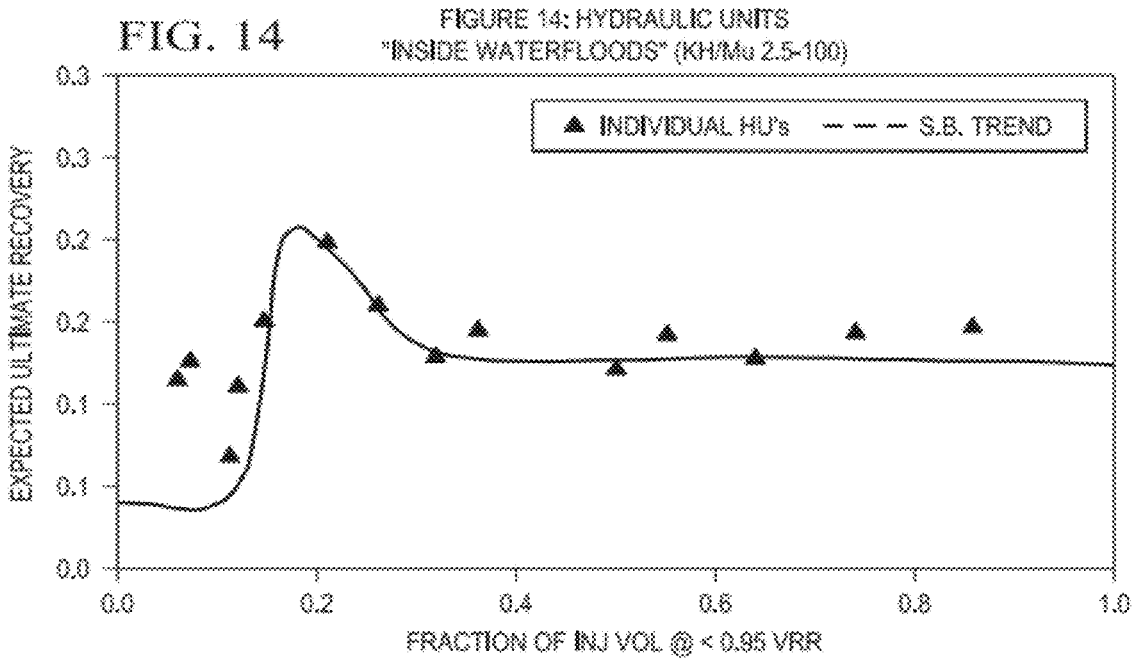
FIG. 14 is a graphical illustration of data for Example 5 showing a "sweet spot" for EUR when the fraction of injected fluid volume injected at a VRR of <0.95 is from about 0.15 to 0.3 (15 to 30% of the cumulative injected displacement fluid).

Similar operation is conducted in the other hydraulic units in the field. Each producer in a hydraulic unit has its specific EUR is estimated by well known decline analysis methods, with the EUR for an individual hydraulic unit, such as HU-10, being the sum of these individual producer well EURs within that hydraulic unit. FIG. 14 is a plot of Fraction of the Injection Volume at a VRR<0.95 vs. the EUR for each hydraulic unit. By taking the minimum recovery observed on FIG. 14 for each hydraulic unit, the phenomenon of increased EUR occurs when 15% to 30% of the cumulative volume of the injection water is conducted at a VRR<0.95.

The above specific embodiments of the invention illustrate a number of points. For example, the benefit of increase in minimum EUR may occur when pre-waterflood production has been limited to 1 to 4% of OIP (optimum pre-production is API gravity dependent). If this level of pre-production is exceeded, it is believed (and without wishing to be bound by theory) that reservoir pressure will decline and cause the gas saturation to exceed the critical gas saturation. The gas bubbles come out of solution, coalesce, and flow to the production wells. It is believed that this production of excessive gas removes a potential major source of energy from the reservoir that, if otherwise kept within the reservoir, would assist with expelling oil and increase the EUR. When the pre-production is limited and followed by a balanced waterflood as disclosed herein, the critical gas saturation is not reached and excess gas is not produced. By retaining the gas in solution, it is believed that formation of a gas-oil emulsion is promoted which is then swept out of the reservoir by the waterflood. However, it is believed that a VRR which is consistently<1.0, i.e., one that is not balanced to within a designated cumulative VRR as described above, coupled with the pre-production permits the reservoir pressure to decline to the point where the critical gas saturation is reached. The reservoir then produces at an elevated GOR, excessive gas is produced, and it is believed that the energy associated with the expansion of this produced gas is lost resulting in a loss of recoverable reserves. Therefore it is imperative to limit the pre waterflood production and then to initiate a balanced waterflood with a cumulative VRR~1.0, i.e., a range from 0.6 to 1.25 or particularly from 0.93 to 1.11, to maximize the recovery.

Periods of underinjection (the VRR<0.95) which are followed with periods of increased injection (overinjection) so that the cumulative VRR is ~1.0, i.e., a range from 0.6 to 1.25 or particularly from 0.93 to 1.11, contribute to increases in the EUR by what is believed to be the same mechanism. As with the pre-production limit prior to waterflooding, a VRR of <0.95 is believed to allow the reservoir pressure to decline and promote formation of a gas-oil emulsion. After the formation of the gas-oil emulsion with the lower VRR, it is necessary to increase the VRR so the cumulative VRR~1.0 as previously described. This increased water injection sweeps the gas-oil emulsion which has been generated within the reservoir to the producers. It also stabilizes the gas-oil emulsions by keeping the reservoir pressure above the bubble point while the emulsion is produced out of the reservoir. During the periods where the VRR<0.95, it is believed that a foamy gas-oil emulsion is created and expands into the swept areas where it is carried to producer by the injected water. After the cumulative reservoir voidage is brought back into balance, the stage is set for the cycle to be repeated as previously described herein.

The same characteristics of heavy oil known to support formation of so-called foamy oil in cold production—high viscosity and the presence of natural surfactants—are believed to encourage formation of foamy oil during heavy oil waterflooding. Generally, the waterfloods of gas-oil emulsions are in reservoirs with less viscous oils than those produced by foamy cold oil production alone. Therefore the gas saturations and reservoir pressures where the gas begins to coalesce are higher for the gas-oil emulsion waterfloods than for the foamy cold oil production but the process of forming the gas-oil emulsions is the same. In the foamy cold oil production the gas-oil emulsions tend to be more stable because of the heavier oils than in the gas-oil emulsion waterfloods, and the foamy gas-oil emulsions flow to the low pressure of the producer. In the gas-oil emulsion waterfloods the emulsion, providing that the reservoir pressures are maintained above the point where critical gas saturation occurs, is believed to be swept out of the reservoir by the injected water. However, it is also believed that if the reservoir pressure is allowed to fall to the point where the gas bubbles begin to coalesce, the gas bubbles similarly connect, the gas-oil emulsion collapses, and the overall recovery efficiency of the gas-oil emulsion waterflood suffers.

In an embodiment, an operating procedure for optimal production from both "inside" and "outside" waterfloods is virtually identical for reservoirs where the oil API gravity>than 17°. Pre-produce a specific fraction of the OIP (API gravity dependent) prior to starting the waterflood; do not pre-produce either too little or too much. Make up the initial under voidage from pre-production with a VRR slightly greater than 1.0 to 1.2 (for example 1.05 to 1.1) with a target of the cumulative VRR of 0.93 to 1.11. This is believed to be important in order to stabilize the gas-oil emulsions that have been created. When the cumulative VRR is about 1.0 and the gas-oil emulsion has been stabilized and WOR thereafter increases to a value above 1, the VRR should then be adjusted to below 0.95 until the GOR starts to increase above the initial solution GOR for the reservoir, such as to a GOR of at least 2 times the initial solution GOR, and more particularly at least 5 times the initial solution GOR. Allowing the GOR to rise, such as to at least 2 times the solution GOR, allows the inherent energy of the reservoir, due to gas in solution, to promote formation of gas-oil foamy emulsions and/or water-in—oil emulsions for more effective waterflooding. However, excessive amounts of underinjection at a VRR<0.95 can lead to inefficient use of such reservoir energy and excessive gas production. Once the GOR reaches a desired point, such as a GOR of at least 2 times the solution GOR, then the VRR is adjusted to provide for overinjection, such as a VRR of 1 to 1.2 until the cumulative VRR is within the desired range of 0.93 and 1.11, typically it is targeted to a cumulative VRR of about 1. This period of overinjection is maintained until the WOR again increases to an undesired level, such as a WOR of greater than 1. Cycles of reducing the VRR below 0.95 for a period of time and then increasing the VRR so as to make up the cumulative VRR is then desirably repeated for one or more cycles as the economics for the continued operation of the reservoir permits.

Waterfloods of 17-23° API pre-produce 1.5 to 2.5% OIP before initiating the waterflood Target 15 to 30% of injection volume to be injected at VRR<0.95

Target cumulative VRR of 0.93 to 1.11 for "inside" waterfloods

Waterfloods of <17° API

Pre-production up to 8% of OIP is not detrimental to EUR

Target 30 to 50% of injection volume to be injected at VRR<0.95

While the methods disclosed herein do not require assistance from use of external agents, such as viscosifiers, polymers emulsifying agents and the like as previously mentioned, it is believed that their use may promote or otherwise maintain emulsion effects within the formation and thereby facilitate the practice of the invention by stabilizing emulsions comprised of one or more of oil, gas, and water. Further, using injection water of relatively low salinity in comparison to the water produced from the formation, such as generally described in U.S. Pat. No. 7,455,109, may also enhance the same or similar effects.

From the foregoing detailed description of specific embodiments, it should be apparent that patentable methods and systems have been described. Although specific embodiments of the disclosure have been described herein in some detail, this has been done solely for the purposes of describing various features and aspects of the methods and systems, and is not intended to be limiting with respect to the scope of the methods and systems. It is contemplated that various substitutions, alterations, and/or modifications, including but not limited to those implementation variations which may have been suggested herein, may be made to the described embodiments without departing from the scope of the appended claims. The teachings of the relevant portions of the patents and publications cited hereinabove are incorporated herein by reference.

We claim:

1. A method of recovering oil and other formation fluids from a reservoir comprising an oil-bearing reservoir rock and having at least one production well and at least one injection well and conducting secondary production operations using a displacement fluid, and wherein the produced oil has a gravity in the range of ≦30° API, the method comprising the steps of:

(a) overinjecting the displacement fluid into the reservoir rock at a voidage replacement ratio (VRR) of from 0.95 to 1.11 until the produced fluids reach a water to oil ratio (WOR) of at least 0.25;

(b) underinjecting the displacement fluid into the reservoir rock at a VRR of <0.95 until the produced fluids have a gas to oil ratio (GOR) of at least 2 times the solution GOR of the initial oil produced from the well; and (c) repeating steps (a) and (b) one or more times, wherein during water injection a cumulative VRR is maintained within a range of 0.6 to 1.25.

2. A method as claimed in claim 1 wherein the produced oil has a gravity in the range of 17 to 30° API and wherein 1 to 4% of the original oil in place (OIP) is produced from the reservoir prior to commencing injection of water into the reservoir rock.

3. A method as claimed in claim 1 wherein the produced oil has a gravity in the range of 17 to 23° API and wherein 1.5 to 3% of the original oil in place is produced from the reservoir prior to commencing injection of water into the reservoir rock.

4. A method as claimed in claim 1 wherein the produced oil has a gravity in the range of <17° API and wherein up to 8% of the original oil in place (OIP) is produced from the reservoir prior to commencing injection of water into the reservoir rock.

5. A method as claimed in claim 1 wherein in step (a) the water is injected at a VRR of from greater than 1 to 1.11.

6. A method as claimed in claim wherein in step (a) the water is injected at a VRR of from 0.95 to 1.

7. A method as claimed in claim 1 wherein in step (a) the water is injected until the WOR is greater than 1.

8. A method as claimed in claim 1 wherein in step (b) the water is injected at a VRR of from 0.5 to 0.85.

9. A method as claimed in claim 1 wherein in step (b) the water is injected at a VRR of from 0.6 to 0.8.

10. A method as claimed in claim 1 wherein in step (b) the water is injected until the produced fluids have a gas to oil ratio (GOR) of at least 5 times the solution GOR of the initial oil produced from the well.

11. A method as claimed in claim 2 wherein the cumulative volume of water that is injected into the reservoir rock when the VRR is less than 0.95 is in the range of 15 to 30% based on the total cumulative volume of water that is injected into the reservoir.

12. A method as claimed in claim 1 wherein during overinjection the cumulative VRR is adjusted to within a range of from 0.93 to 1.11.

13. A method as claimed in claim 1 wherein during overinjection the cumulative VRR is adjusted to within a range of from 0.95 to 1.05.

14. A method as claimed in claim 1 wherein the WOR is at least 0.4.

15. A method as claimed in claim 1 wherein the WOR is at least 0.75.

16. A method as claimed in claim 3 wherein the cumulative volume of water that is injected into the reservoir rock when the VRR is less than 0.95 is in the range of 15 to 30% based on the total cumulative volume of water that is injected into the reservoir.

17. A method as claimed in claim 4 wherein the cumulative volume of water that is injected into the reservoir rock when the VRR is less than 0.95 is in the range of 30 to 50% based on the total cumulative volume of water that is injected into the reservoir.

18. A method as claimed in claim 1 wherein the value of Kh/μ for the reservoir is in the range of 1.2 to 100 mD-ft/cP wherein K is the average permeability of the reservoir rock in millidarcies (mD), h is the height of the producing interval of the reservoir in feet (ft), and μ is the viscosity of the oil at reservoir conditions in centipoise (cP).

19. A method of recovering oil and other formation fluids from a reservoir comprising an oil-bearing reservoir rock and having at least one production well and at least one injection well and conducting secondary production operations using a displacement fluid, and wherein the produced oil has a gravity in the range of 17 to 30° API, the method comprising the steps of (a) producing 1 to 4% of the original oil in place (OIP) from the reservoir prior to commencing injection of the displacement fluid into the reservoir rock;

(b) overinjecting the displacement fluid into the reservoir rock at a voidage replacement ratio (VRR) of from 0.95 to 1.11 until the produced fluids have a water to oil ratio (WOR) of at least 0.25;

(c) underinjecting the displacement fluid into the reservoir rock at a VRR of <0.95 until the produced fluids have a gas to oil ratio (GOR) of at least 2 times the solution GOR of the initial oil produced from the well; and (d) repeating steps (b) and (c) one or more times, wherein during displacement fluid injection a cumulative VRR is maintained within a range of 0.6 to 1.25.

20. A method as claimed in claim 19 wherein the produced oil has a gravity in the range of 17 to 23° API and wherein 1.5 to 3% of the original oil in place is produced from the reservoir prior to commencing injection of water into the reservoir rock.

21. A method as claimed in claim 19 wherein in step (b) the water is injected at a VRR of from greater than 1 to 1.11.

22. A method as claimed in claim 19 wherein in step (b) the water is injected at a VRR of from 0.95 to 1.

23. A method as claimed in claim 19 wherein in step (b) the water is injected until the WOR is greater than 1.

24. A method as claimed in claim 19 wherein in step (c) the water is injected at a VRR of from 0.5 to 0.85.

25. A method as claimed in claim 19 wherein in step (c) the water is injected at a VRR of from 0.6 to 0.8.

26. A method as claimed in claim 19 wherein in step (c) the water is injected until the produced fluids have a gas to oil ratio (GOR) of at least 5 times the solution GOR of the initial oil produced from the well.

27. A method as claimed in claim 19 wherein the cumulative volume of water that is injected into the reservoir rock when the VRR is less than 0.95 is in the range of 15 to 30% based on the total cumulative volume of water that is injected into the reservoir.

28. A method as claimed in claim 19 wherein the value of Kh/μ for the reservoir is in the range of 1.2 to 100 mD-ft/cP wherein K is the average permeability of the reservoir rock in millidarcies (mD), h is the height of the producing interval of the reservoir in feet (ft), and μ is the viscosity of the oil at reservoir conditions in centipoise (cP).

29. A method as claimed in claim 19 wherein during overinjection the cumulative VRR is adjusted to within a range of from 0.93 to 1.11.

30. A method as claimed in claim 19 wherein during overinjection the cumulative VRR is adjusted to within a range of from 0.95 to 1.05.

31. A method as claimed in claim 19 wherein the WOR is at least 0.4.

32. A method as claimed in claim 19 wherein the WOR is at least 0.75.

33. A method of recovering oil and other formation fluids from a reservoir comprising an oil-bearing reservoir rock and having at least one production well and at least one injection well and conducting secondary production operations using a displacement fluid, wherein the produced oil has a gravity in the range of <17° API, the method comprising the steps of:

(a) producing up to 8% of the original oil in place (OIP) from the reservoir prior to commencing injection of the displacement fluid into the reservoir rock;

(b) overinjecting displacement fluid into the reservoir rock at a voidage replacement ratio (VRR) of from 0.95 to 1.11 until the produced fluids have a water to oil ratio (WOR) of at least 0.25;

(c) underinjecting displacement fluid into the reservoir rock at a VRR of <0.95 until the produced fluids have a gas to oil ratio (GOR) of at least 2 times the solution GOR of the initial oil produced from the well; and (d) repeating steps (b) and (c) one or more times, wherein during displacement fluid injection a cumulative VRR is maintained within a range of 0.6 to 1.25.

34. A method as claimed in claim 33 wherein in step (b) the water is injected at a VRR of from greater than 1 to 1.11.

35. A method as claimed in claim 33 wherein in step (b) the water is injected at a VRR of from 0.95 to 1.

36. A method as claimed in claim 33 wherein in step (c) the water is injected until the WOR is greater than 1.

37. A method as claimed in claim 33 wherein in step (c) the water is injected at a VRR of from 0.5 to 0.85.

38. A method as claimed in claim 33 wherein in step (c) the water is injected at a VRR of from 0.6 to 0.8.

39. A method as claimed in claim 33 wherein in step (c) the water is injected until the produced fluids have a gas to oil ratio (GOR) of at least 5 times the solution GOR of the initial oil produced from the well.

40. A method as claimed in claim 33 wherein the cumulative volume of water that is injected into the reservoir rock when the VRR is less than 0.95 is in the range of 30 to 50% based on the total cumulative volume of water that is injected into the reservoir.

41. A method as claimed in claim 33 wherein the value of $Kh/\mu$ for the reservoir is in the range of 1.2 to 100 mD-ft/cP wherein K is the average permeability of the reservoir rock in millidarcies (mD), h is the height of the producing interval of the reservoir in feet (ft), and $\mu$ is the viscosity of the oil at reservoir conditions in centipoise (cP).

42. A method as claimed in claim 33 wherein during over-injection the cumulative VRR is adjusted to within a range of from 0.93 to 1.11.

43. A method as claimed in claim 33 wherein during over-injection the cumulative VRR is adjusted to within a range of from 0.95 to 1.05.

44. A method as claimed in claim 33 wherein the WOR is at least 0.4.

45. A method as claimed in claim 33 wherein the WOR is at least 0.75.

* * * * *